United States Patent [19]

Shiraishi

[11] Patent Number: 4,647,277

[45] Date of Patent: Mar. 3, 1987

[54] APPARATUS FOR MANUFACTURING ELECTRIC LAMPS

[75] Inventor: Isao Shiraishi, Yokosuka, Japan

[73] Assignee: Kabushiki Kaisha Toshiba, Kawasaki, Japan

[21] Appl. No.: 801,228

[22] Filed: Nov. 25, 1985

[30] Foreign Application Priority Data

Nov. 30, 1984 [JP] Japan ..... 59-253052
Jul. 31, 1985 [JP] Japan ..... 60-167744

[51] Int. Cl.[4] ..... H01J 9/26; H01J 9/48

[52] U.S. Cl. ..... 445/67; 445/69; 445/71

[58] Field of Search ..... 445/66, 67, 69, 70, 445/71

[56] References Cited

U.S. PATENT DOCUMENTS 2,327,033 8/1943 Flaws ..... 445/67 X
2,685,762 8/1954 Mullar ..... 445/71
3,226,175 12/1965 Russell ..... 445/66
3,295,183 1/1967 Orebic ..... 445/66

*Primary Examiner*—Kenneth J. Ramsey
*Attorney, Agent, or Firm*—Cushman, Darby & Cushman

[57] ABSTRACT

A manufacturing apparatus includes an endless chain traveling along a prescribed path. A plurality of holding chucks for clamping a stem tube or bulb are fitted to the chain and moved along the path. A mount-making unit is arranged near the path and seal a pair of leads to the stem tube held by the chuck to make a mount. A sealing unit is arranged near the path. The unit takes up the mount from the chuck passed the mount-making unit and then seals the mount in the bulb held by the chuck. An evacuating unit is arranged near the path. The unit evacuates the bulb held by the chuck which is passed the sealing unit, introduces an inert gas into the bulb, and then seals the bulb.

10 Claims, 13 Drawing Figures

APPARATUS FOR MANUFACTURING ELECTRIC LAMPS

BACKGROUND OF THE INVENTION

This invention relates to an apparatus for manufacturing electric lamps such as a glow switch starter and a baseless lamp.

Generally, a method of manufacturing electric lamps, for example, a glow switch starter, includes a mount-making step of making a mount having a pair of leads, a stem tube and a bimetal piece welded to one of the leads; a bulb-making step of making a bulb; a sealing step of inserting the mount into the bulb and sealing one opening of the bulb; an evacuating step of evacuting the bulb, introducing an inert gas thereinto and sealing the bulb; and a lead-processing step of insulating the leads from each other and bending one of the leads.

Hitherto, an apparatus is proposed which is designed for the automatic and continuous manufacture of the glow switch starter through the above-mentioned steps. The conventional manufacturing apparatus comprises a mount-making unit provided with a plurality of equidistantly arranged mount heads and performing the mount-making step; a bulb-making unit; a sealing unit provided with a plurality of equidistantly arranged sealing heads and performing the sealing step; an evacuating unit provided with a plurality of equidistantly arranged evacuating heads and performing the evacuating step; and a lead-processing unit for performing the lead-processing step.

A chain conveyor is arranged between the mount-making unit and sealing unit, and another chain conveyor is arranged between the evacuating unit and lead-processing unit.

In the above apparatus, a mount made by the mount-making unit is shifted from the mount-making unit to the chain conveyor by a shifting mechanism. The chain conveyor transports the mount to the sealing unit. Then, the mount is shifted from the conveyor to the sealing unit by another shifting mechanism and is inserted into a bulb supplied from the bulb-making unit. The product constructed by sealing the bulb is carried to the evacuating unit. The product whose evacuation is completed is transported to another chain conveyor by means of a shifting mechanism. The bulb is delivered within proximity of the lead-processing unit by the chain conveyor and then shifted to the lead-processing unit by still another shifting mechanism. Thus, manufacture of the glow switch starter is concluded through the above-mentioned steps.

In the apparatus described above, the units are arranged in the order of the processing steps, thus ensuring the automatic, continuous manufacture of glow switch starters. As stated above, the chain conveyors are provided, one stretched between the mount-making unit and sealing unit, and the other stretched between the evacuation unit and lead-processing unit. The apparatus has two drawbacks. First, the shifting mechanisms are indispensable. Without them, the unfinished products cannot be transported from the fabricating units to the chain conveyors, or vice versa. Provided with these shifting mechanisms, the apparatus is so complex that a good deal of time should be spent on the maintenance and repair. Secondly, it takes some time to transport the unfinished procuts from the fabricating units to the chain conveyors, or vice versa. Hence, it is difficult with this apparatus to enhance the manufacture efficiency.

Furthermore, it is difficult to transport each ufinished product from every fabricating unit to every chain conveyor, or vice versa, at accurate time. Unless the product is transported at correct time, it will fall or crimped between the members of the conveyor or of the fabricating unit and will eventually damaged. In consequence, the yield of the product is low.

SUMMARY OF THE INVENTION

This invention has been accomplished in view of the above circumstances, and is intended to provide an apparatus for manufacturing electric lamps, which is not require shifting mechanisms, thereby reducing the number of parts and preventing damage of products, and which can ensure improvement in the manufacture efficiency.

To attain the above object, this invention provides an apparatus which comprises: an endless conveyor running along a prescribed path; holding means for selectively holding the mount or bulb, the holding means being fitted to the conveyor and made to run with the conveyor along the path; drive means for driving the conveyor; stem tube-feeding means for feeding a stem tube to the holding means; a mount-making unit arranged near the conveyor path, for sealing a pair of leads in the stem tube fed to the holding means from the stem tube-feeding means and held by the holding means, thereby making a mount; bulb-feeding means for feeding a bulb to the holding means; a sealing unit arranged near the conveyor path, for taking up the mount from the holding means which is passed the mount-making means, inserting the mount into the bulb which is fed from the bulb feeding means to the holding means and held by holding means, and sealing the mount and bulb; and an evacuating unit set near the conveyor path, for evacuating the bulb held by the holding means which is passed the sealing unit, introducing an inert gas into the evacuated bulb and then sealing the bulb.

BRIEF DESCRIPTION OF THE DRAWINGS

FIGS. 3 to 13 illustrate a manufacturing apparatus according to an embodiment of the invention: in which FIG. 3 is a plan view of the whole manufacturing apparatus, FIG. 4 is a sectional view taken along a line III—III in FIG. 3, FIGS. 5 and 6 are respectively enlarged plan and side views of the chain conveyor, FIGS. 7 and 8 are respectively plan and side views of the mount head of the mount-making unit, FIG. 9 is a partial side view of the sealing unit and centering unit, FIG. 10 is a plan view of the sealing head, FIG. 11 is a plan view of the centering unit, FIG. 12 is a partial front view of the centering unit, and FIG. 13 is a sectional view of the evacuating unit.

DETAILED DESCRIPTION OF THE PREFERRED EMBODIMENT

Figure 1:
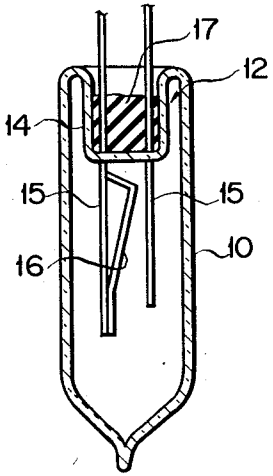
FIG. 1 is a sectional view of a glow switch starter.

Description may now be made with reference to the accompanying drawings of a manufacturing apparatus embodying this invention. FIG. 1 shows an ordinary glow switch starter. The glow switch starter includes a bulb 10 and a mount 12 sealed in one end portion of the bulb. The mount 12 has a stem 14 sealed in the bulb 10, a pair of leads 15 extending into the sealed bulb 10, and a bimetal 16 welded to one of the leads. The stem 14 is filled with an insulating material 17 for isolating the leads 15 from each other.

Figure 2:
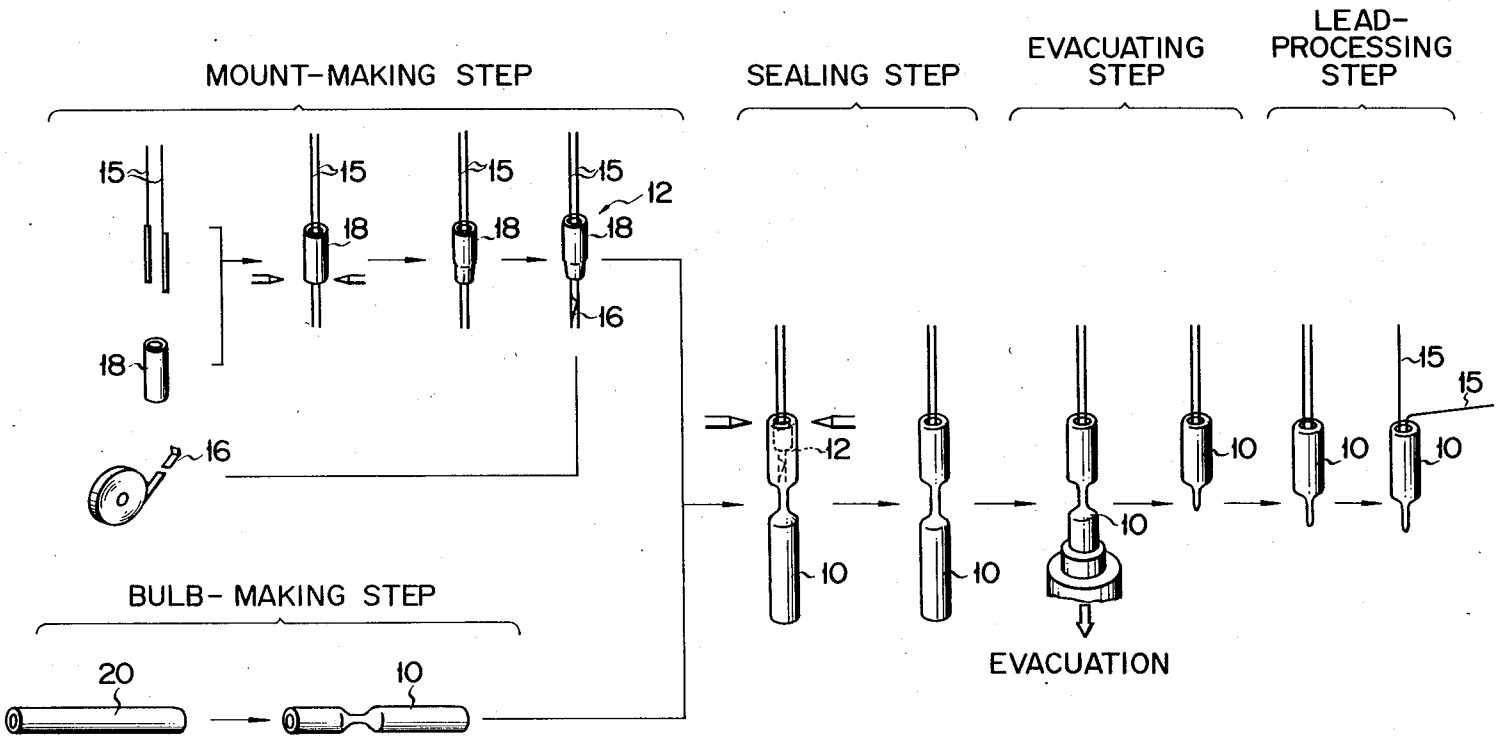
FIG. 2 is a view schematically showing the sequential steps of manufacturing the starter.

The starter is manufactured by the steps shown in FIG. 2. First, a pair of previously provided leads 15 are inserted into a glass stem tube 18. The prescribed portion of the stem tube 18 is fused to seal and fix the leads 15 to the stem tube. Then, a previously cut and bent bimetal piece 16 is welded to one of the leads 15, thereby fabricating the mount 12. The processes up to this point are collectively referred to as a mount-making step.

A bulb-making step is taken together with the mount-making step. In this bulb-making step, the prescribed section of a previously cut glass tube 20 is its diameter reduced by thermally softening and pressing, thereby providing the bulb 10.

After the mount 12 is taken into the bulb 10 through one end opening thereof, the mount 12 is sealed in the bulb 10 by thermally fusing the open end. These processes are referred to as a sealing step.

Then, the air in the bulb 10 is evacuated from the other open end, and an inert gas such as argon gas is taken into the bulb in place of air. Thereafter the smaller diameter section of the bulb 10 is thermally fused, thereby being sealed and severed. These processes are referred to as an evacuating step.

Later, an insulating substance is carried into the stem 14 to effect insulation between the paired leads 15. At this time, one of the leads 15 is bent outward. The foregoing process is referred to as the lead-processing step.

Figure 3:
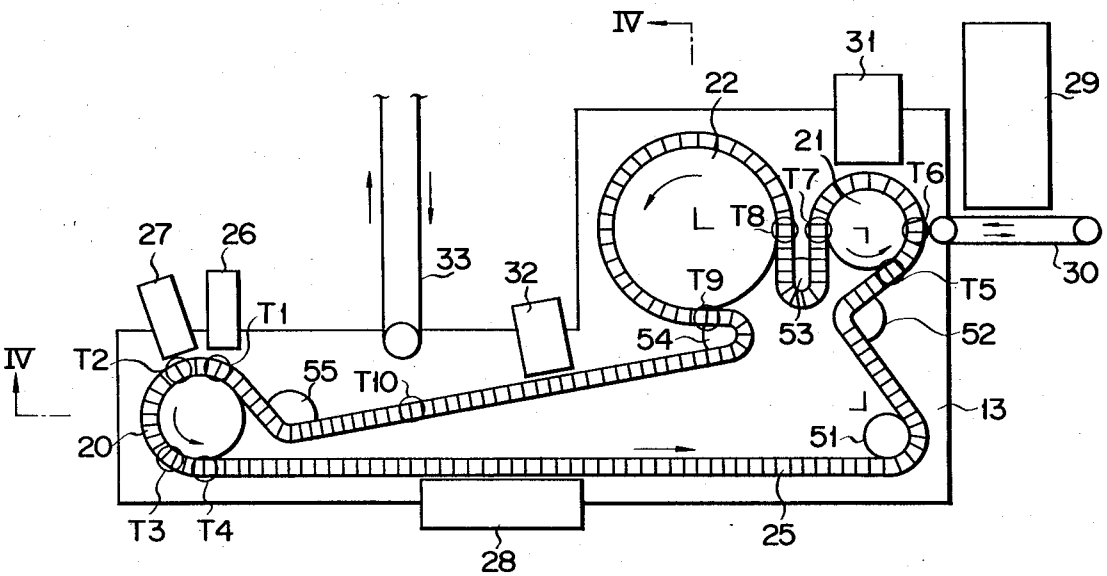

Glow switch starters are manufactured through the above-mentioned steps. Description may now be made of a manufacturing apparatus embodying this invention. As schematically shown in FIG. 3, the manufacturing apparatus comprises a base 13 and a mount-making unit 20, sealing unit 21 and evacuating unit 22 all mounted on the base. The apparatus also comprises an endless chain 25 acting as a conveyor which is arranged so as to pass by the mount-making unit, sealing unit and evacuating unit in turn, and a plurality of holding chucks fitted to the chain 25 to be driven therewith and selectively catching the mount 12 or bulb 10 as need arises. Provided near the mount-making unit 20 are a lead-supplying unit 26 for conducting leads to the mount-making unit 20 and a stem tube-feeding unit 27 for delivering stem tubes to the holding chucks. An electric furnace 28 for thermally processing the leads is installed near the path of the endless chain 25 between the mount-making unit 20 and sealing unit 21. Provided near the sealing unit 21 are a bulb-making unit 29, a bulb-feeding unit 30 for delivering bulbs to the holding chucks, and a centering unit 31 for centering the mount with the bulb. Provided near the path of the endless chain 25 between the evacuating unit 22 and mount-making unit 20 are a lead-processing unit 32 for introducing an insulating material into the stem and bending the lead, and a chain conveyor 33 for taking out finished glow switch starters.

Figure 4:
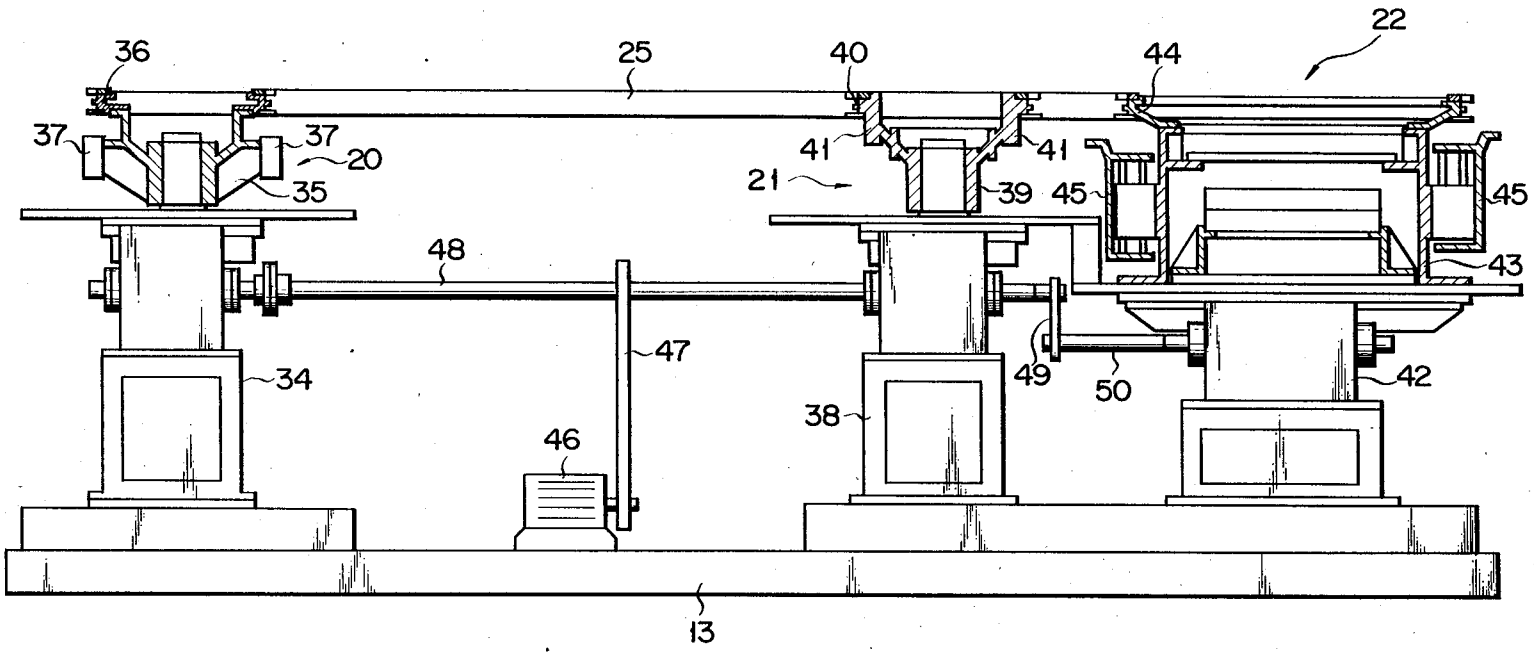

As shown in FIG. 4, the mount-making unit 20 includes a support rest 34 arranged on the base 13 and a turn table 35 supported on the support rest 34 to be rotatable about a vertical axis. Mounted on the turn table 35 is a first sprocket 36 acting as a rotatable drive member. The sprocket 36 is rotated integrally with the turn table 35 about the same axis as the turn table. A plurality of mount heads 37 are fixed to the turn table 35. These mount heads 37 are equidistantly arranged in a circle around the axis of the turn table 35. The mount heads 37 are integrally rotated with the turn table and sprocket 36. The arrangement of each mount head 37 will be described later.

The sealing unit 21 includes a support rest 38 arranged on the base 13 and a turn table 39 held on the support rest 38 to be rotatable about a vertical axis. Mounted on the turn table 39 is a second sprocket 40 acting as a rotatable drive member to be integrally rotated with the turn table 39 about the same axis. A plurality of sealing heads 41 are fixed to the turn table 39. These sealing heads 41 are equidistantly arranged in a circle around the center of the turn table 39. The distance between the respective sealing heads 41 is made equal to the pitch between the mount heads 37 of the mount-making unit 20. The sealing heads 41 are integrally rotated with the turn table 39 and sprocket 40.

The evacuating unit 22 includes a support rest 42 built on the base 13 and a turn table 43 mounted on the support rest 42 to be rotatable about a vertical axis. Mounted on the turn table 43 is a third sprocket 44 acting as a rotatable drive member so as to be rotated integrally with the turn table 43 about the same axis. A plurality of evacuation heads 45 are fitted to the turn table 43. These evacuation heads 45 are equidistantly arranged in a circle around the axis of the turn table 43. The evacuation heads 45 are set apart from each other at the same distance as that of the mount heads 37 of the mount-making unit 20. The evacuation heads 45 are rotated interlockingly with the turn table 43 and sprocket 44.

The sprocket 36 and turn table 35 of the mount-fabricating unit 20 are driven at a constant speed by a motor 46 mounted on the base 13 through a drive belt 47, drive transmission shaft 48 and reduction gear mechanism (not shown). The sprocket 40 and turn table 39 of the sealing unit 21 are driven by the motor 46 through the drive belt 47, drive transmission shaft 48, and a reduction gear mechanism (not shown). The sprocket 44 and turn table 43 of the evacuating unit 22 are driven by the motor 46 with the aid of the drive belt 47, drive transmission shaft 48, drive belt 49, drive-transmitting shaft 50 and reduction gear mechanism (not shown). The turn table 39 of the sealing unit 21 and the turn table 43 of the evacuating unit 22 are rotated so that that the sealing heads 41 and evacuation heads 45 have the same angular speed as that of the mount heads 37 of the mount-making unit.

The first to third sprockets 36, 40, 44 are set on the same horizontal plane. The chain 25 are stretched over the first to third sprockets 36, 40, 44 for engagement therewith. Therefore, the chain 25 runs at a prescribed speed corresponding to the rotation of the sprockets. Referring to FIG. 3, reference numerals 51, 52 represent tension sprockets engaged with the chain 25 to impart a prescribed tension thereto. Reference numerals 53, 54, 55 denote intermediate sprockets for taking up the chain 25 about the first to third sprockets.

Figure 5:
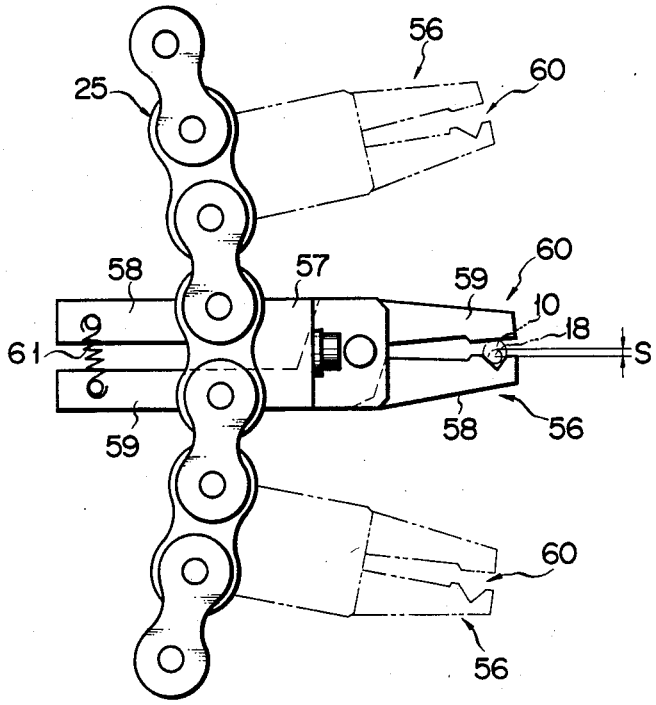
Figure 6:
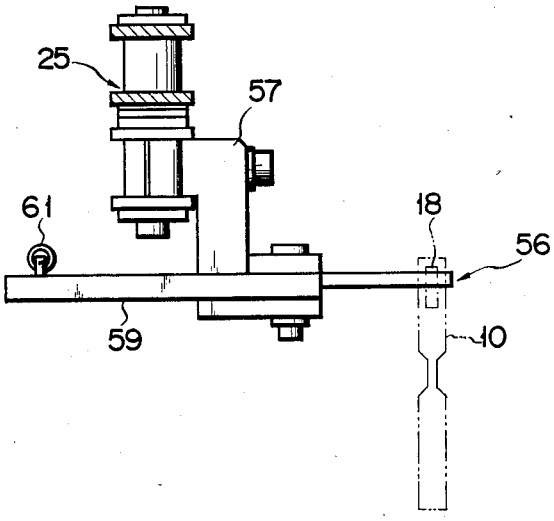

The chain 25 is fitted with a plurality of holding chucks 56 for selectively holding the stem tube 18 or bulb 10 as need arises. The chucks 56 are set apart from one another at a distance equal to the pitch between the mount heads 37 of the mount-making unit 20 in a direction in which the chain 25 travels. As shown in FIGS. 5 and 6, each chuck 56 includes a coupler 57 connected to the chain 25 by means of the chain pins of the chain and a pair of chuck arms 58, 59 whose intermediate portion is fitted to the coupler. One chuck arm 58 is unrotatably fitted to the coupler 57, and the other chuck arm 59 is rotatably fitted to the coupler. The chuck arms 58, 59 are provided at one end with a clamping section 60 for selectively holding the stem tube 18 or bulb 10 having different diameters. Stretched between the other end of the chuck arms 58, 59 is a tension spring 61 to urge the chuck arms in such a direction as causes the clamping section 60 to be closed. The holding chuck 56 is left open by forcefully pushing away the rotatable chuck arm 59 by means of an opening device (not shown).

Figure 7:
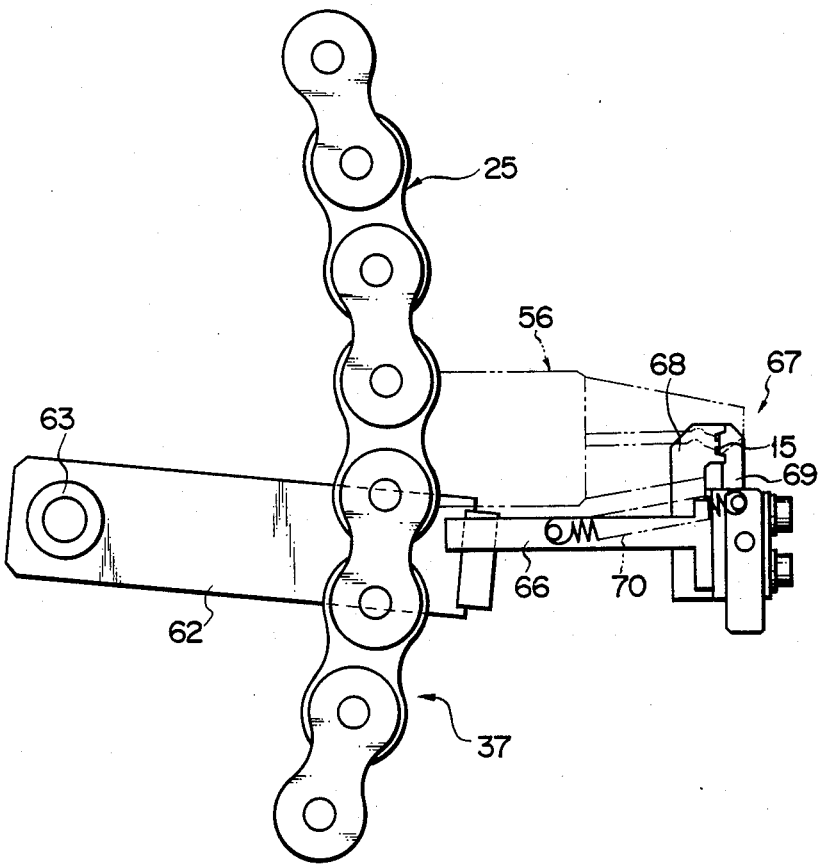
Figure 8:
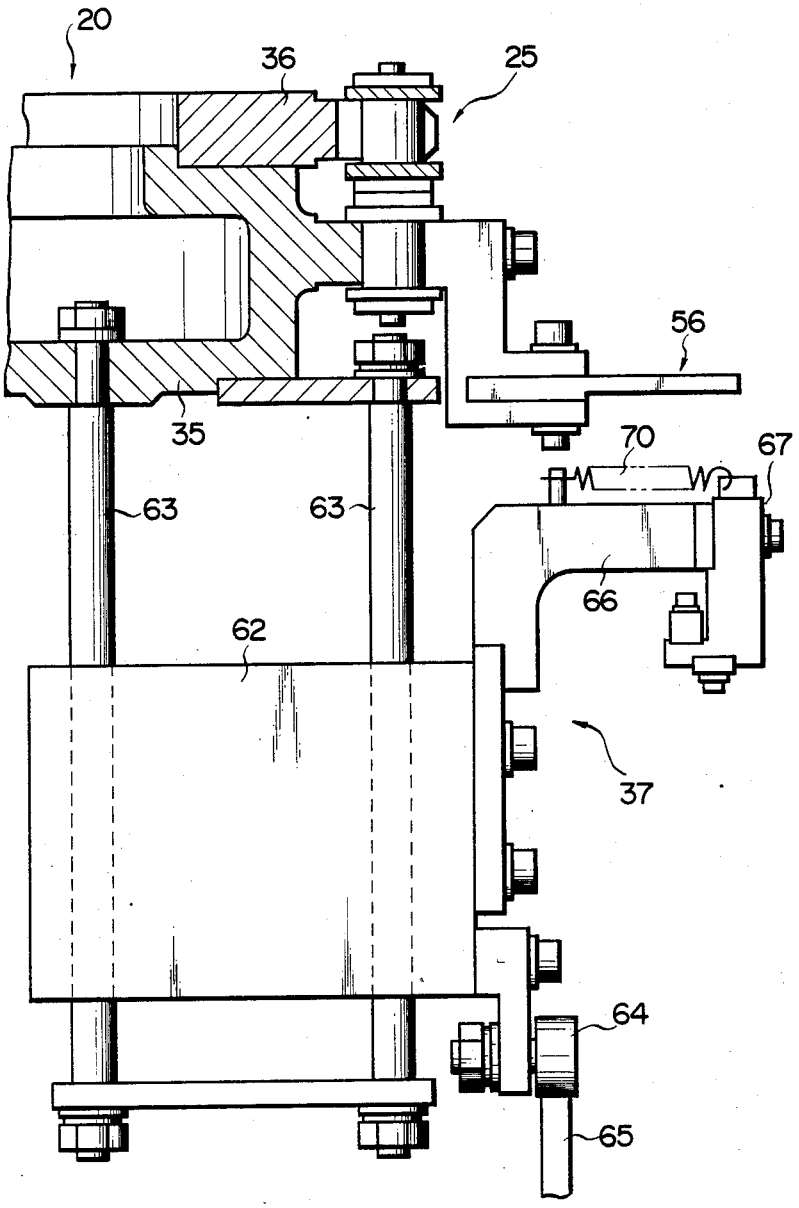

As shown in FIGS. 7 and 8, each mount head 37 of the mount-making unit 20 comprises a lifting rest 62 which is supported by the turn table 35 and lies below the first sprocket 36. The lifting rest 62 is guided to move vertically by means of a pair of parallel guide rods 63 fixed to the turn table 35. When a cam follower 64 attached to the lifting rest 62 is pushed by a cam 65 mounted on the support rest 34, the lifting rest 62 rises from the position shown in FIG. 8. A mount chuck 67 for clamping a pair of leads 15 is fixed to the lifting rest 62 through a support arm 66. The mount chuck 67 includes a fixed lever 68 and movable lever 69. These levers 68, 69 cooperate to clamp a pair of leads 15 therebetween. The movable lever 69 is urged toward the fixed lever 68 by a tension spring 70. The movable lever 69 is opened, if necessary, against the urging force of the spring 70 by means of an opening unit (not shown).

Figure 9:
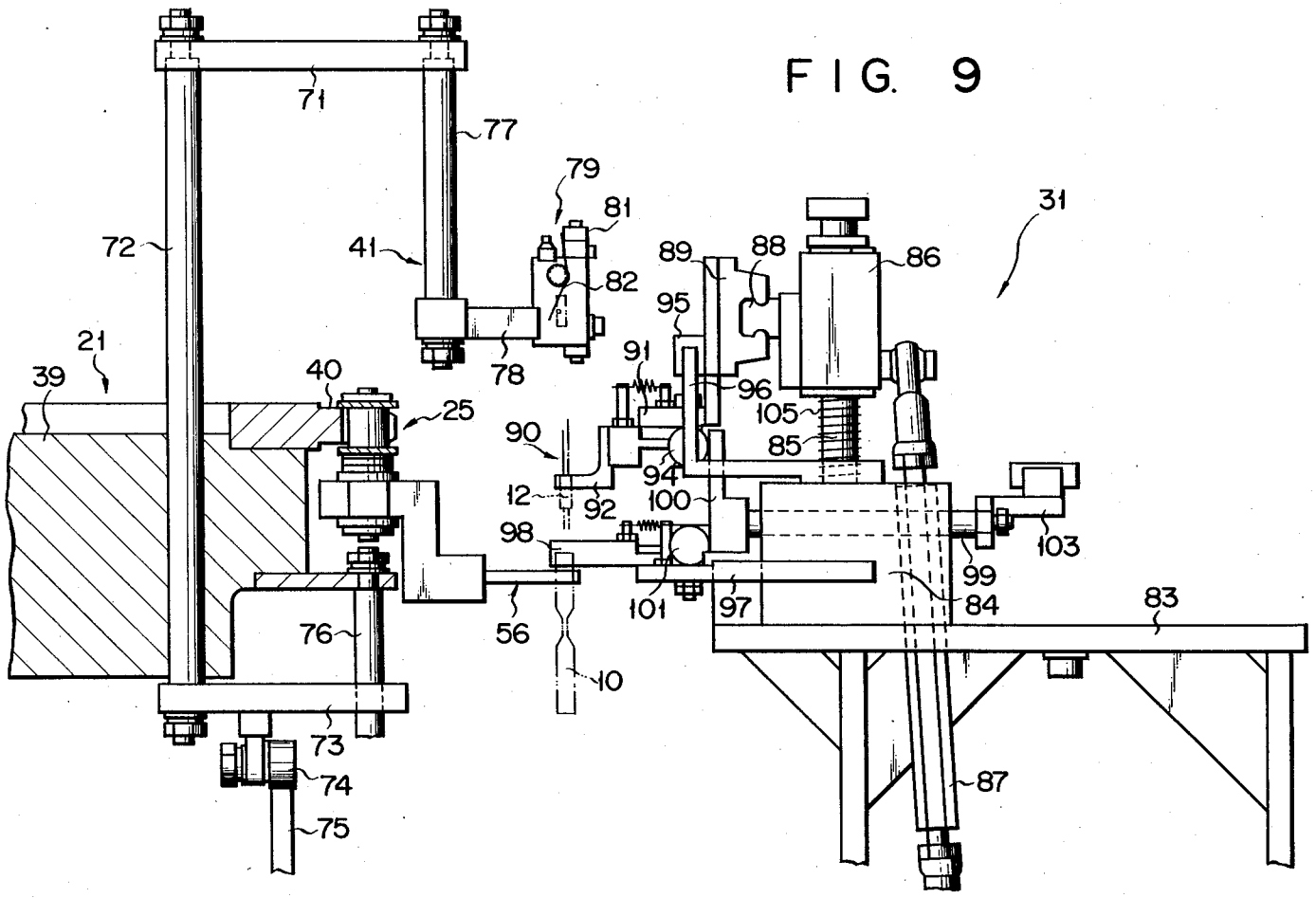
Figure 10:
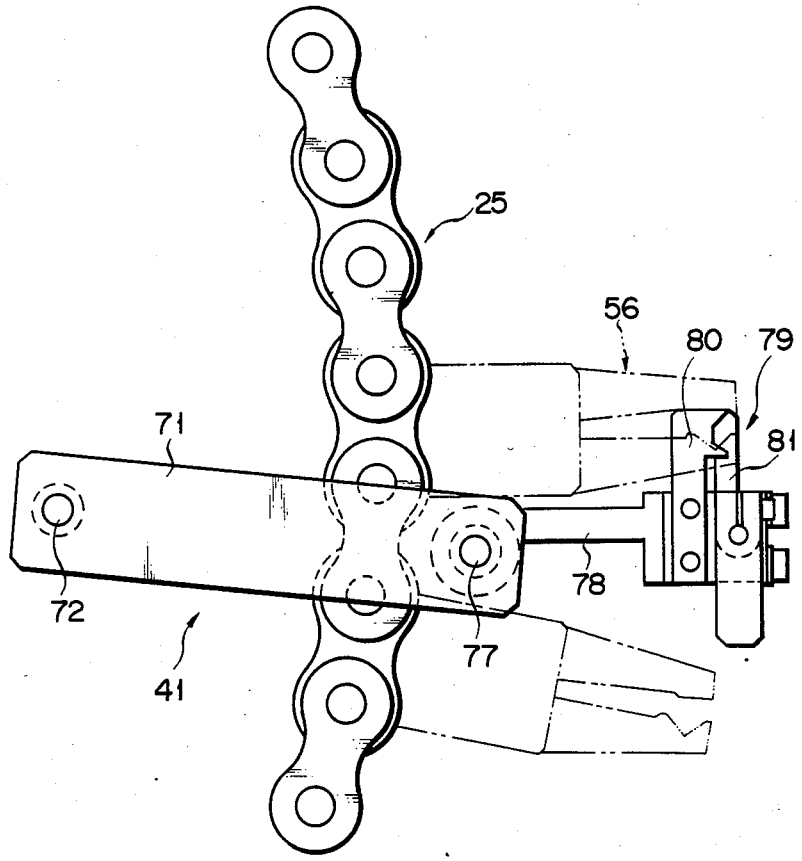

As shown in FIGS. 9 and 10, the respective sealing heads 41 of the sealing unit 21 comprise a lifting board 71 supported by the turn table 39 and located above the second sprocket 40. The lifting board 71 is fixed to the upper end of a lifting rod 72 supported by the turn table 35 so as to be vertically moved. A support board 73 is fixed to the lower end of the lifting rod 72. When a cam follower 74 mounted on the support board 73 is moved interlockingly with a cam 75 set on the support rest 38, the lifting rod 72 and lifting board 71 are brought downward from the positions indicated in FIG. 9. The support board 73 is guided by a guide rod 76 erected on the turn table 39.

A sealing chuck 79 for clamping the leads of the mount 12 (FIG. 1) is fixed to the lifting board 71 through a connecting rod 77 and a support arm 78. The sealing chuck 79 has a fixed lever 80 and movable lever 81. These levers 80, 81 are designed to clamp the upper end portions of the leads of the mount 12 therebetween. The movable lever 81 is urged toward the fixed lever 80 by a tension spring 82. The sealing chuck 79 is opened by an opening device (not shown).

Figure 11:
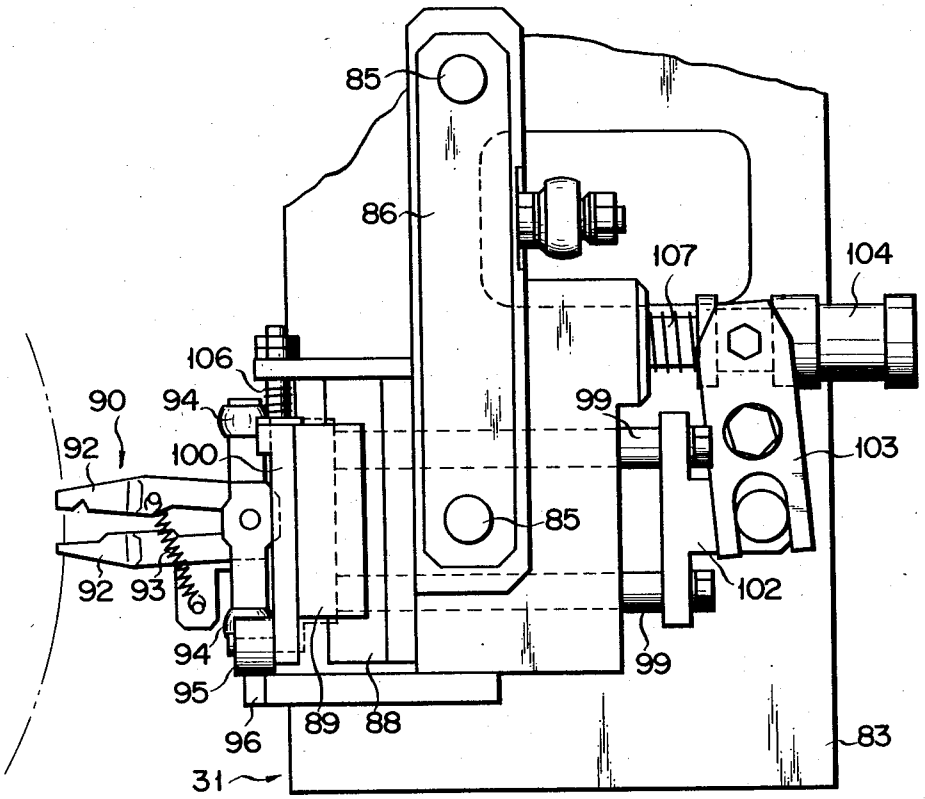
Figure 12:
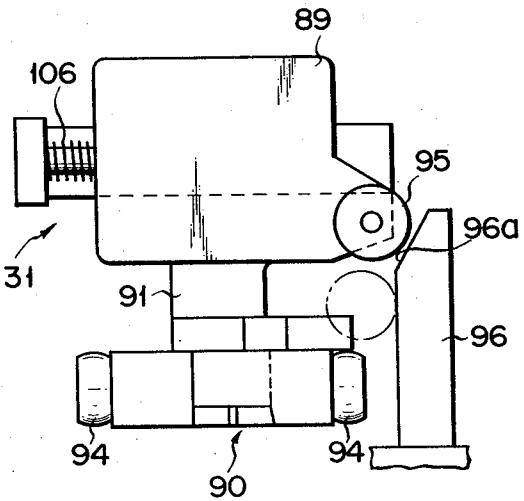

As indicated in FIGS. 9, 11, 12, the centering unit 31 comprises a support rest 83 and a guide block 84 mounted thereon. A pair of parallel guide rods 85 are erected on the guide block 84. A lifting block 86 is supported by the rods 85 to be movable vertically. The block 84 is moved by a drive rod 87.

A horizontally extending guide rail 88 is provided in front of the lifting block 86 facing the sealing unit 21. A horizontally slidable table 89 is mounted on the guide rail 88. The lower end of the slide table 89 is fitted with a centering correction chuck 90. This chuck 90 has a bracket 91 horizontally protruding from the lower end of the slide table 89 and a pair of movable chuck levers 92 rotatably supported by the bracket 91. The chuck levers 92 are normally so urged as to be closed by a tension spring 93, thereby to clamp the stem tube of the mount 12. The rear end of each chuck lever 92 is bent in the form of the letter L, the end of the L-shaped bend being provided with a roller 94.

A cam roller 95 is mounted on one horizontal end of the slide table 89. The roller 95 rolls over a cam surface **96*a* of a guide arm 96 erected on the guide block 84. A pair of sealing burners 98 is fitted to the guide block 84 through support members 97. These burners 98 are intended to heat the upper end of the bulb 10 clamped by the holding chuck 56 of the chain 25, and are opened or closed in accordance with the movement mode of the centering correction chuck 90**.

A pair of parallel slide rods 97 horizontally extend through the guide block 84. Connected to the front ends of the rods 99 is a plate 100 for opening or closing the centering correction chuck 90 and sealing burner 98. The movable plate 100 is pressed against the rollers 95 of the centering correcting chucks 90 and rollers 101 of the burners 98. The rear ends of the slide rods 99 are coupled to a push rod 104 by means of a connection plate 102 and lever 103. When, therefore, the push rod 104 is moved to the right of FIG. 11 by a drive device (not shown), the slide rods 99 are shifted to the left of FIG. 11, causing the movable plate 100 to be carried in the same direction. As a result, the rollers 94 of the centering correction chucks 90 and the rollers 101 of the burners 98 are pushed at the same time by the movable plate 100, thereby opening the centering correction chuck 90 and burner 98.

Throughout FIGS. 9, 10 and 11, reference numerals 105, 106, 107 represent return springs to bring the lifting block 86, slide table 89 and push rod 104 back to the original position.

Figure 13:
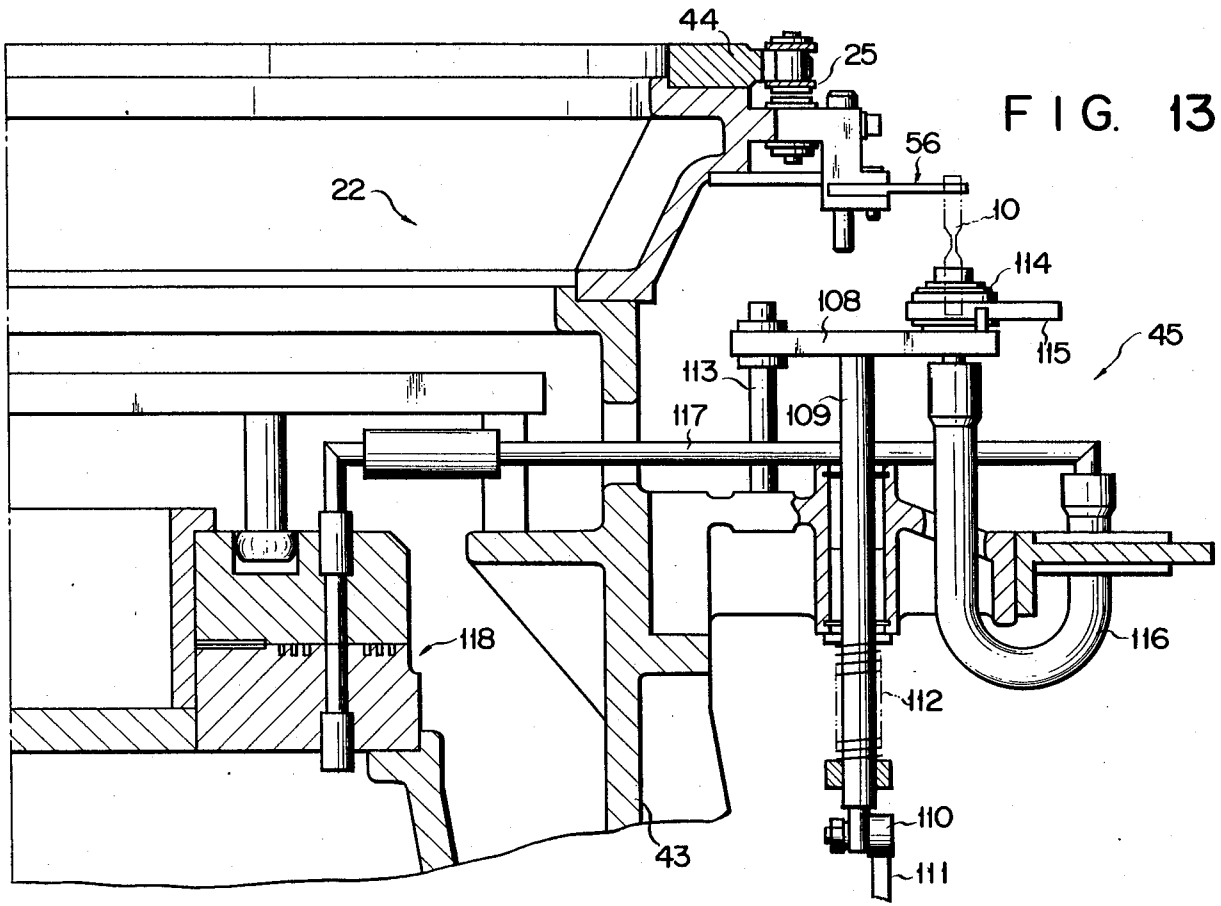

As shown in FIG. 13, the evacuation heads 45 of the evacuating unit 22 are respectively provided with a lifting table 108 which lies below the third sprocket 44 and supported by the turn table 43. The lifting table 108 is fixed to the upper end of a lifting rod 109 supported by the turn table 43 to be moved vertically. The lower end of the lifting rod 109 is fitted with a cam follower 110.

When the cam follower 110 is driven interlockingly with a cam 111 set on the support rest 42 of the evacuating unit 22, the lifting rod 109 is brought downward from the indicated position (FIG. 13). Reference numeral 112 denotes a return spring for bringing the rod 109 back to the original position. The lifting table 108 is engaged with a guide rod 113 fitted to the turn table 43. Mounted on the vertically movable table 108 is a coupler 114 which is adapted to be connected in an airtight fashion to the lower opening of the bulb 10 clamped by the holding chuck 56. The coupler 114 is connected to the bulb 10 in an airtight fashion when the diameter of a coupling rubber member (not shown) is reduced by the rotation of a lever 115. The coupler 114 communicates with a center valve 118 provided in the turn table 43 through a rubber hose 116 and pipe 117. The center valve 118 is switched in accordance with the rotation of the turn table 43, thereby causing the pipe 117 to communicate with a desired pipe. Thus, the step of the evacuating the bulb 10 is shifted to that of introducing an inert gas thereinto.

The operation of the manufacturing apparatus having the above construction will be described. When the motor 46 is driven, the turn table 35 of the mount-making unit 20, the turn table 39 of the sealing unit and the turn table 43 of the evacuating unit 22 are rotated, and the first to third sprockets 36, 40, 44 are rotated at the same angular speed. As a result, the chain 25 and the holding chucks 56 set on the chain travel at a constant speed in the direction of an arrow indicated in FIG. 3. When passing around the first to third sprockets 36, 40, 44, each holding chuck 56 travels while perpendicularly facing the mount head 37 of the mount-fabricating unit 20, and the sealing head 41 of the sealing unit 21 and the evacuation head 45 of the evacuating unit 22.

At point T1 shown in FIG. 3, the lead feeding unit 26 delivers a pair of leads 15 to the mount chuck 67 of the mount-making unit 20. At point T1, the mount chuck 67 is brought downward as indicated in FIG. 8. When the mount chuck 67 reaches point T2, a stem tube 18 is delivered to the holding chuck 56 of the chain 25 by the stem tube-feeding unit 27. The mount chuck 67 clamping the leads 15 and the holding chuck 56 clamping the stem tube are moved from point T2 to point T3 at the same speed while facing each other. During this period, the lifting rest 62 of the mount head 37 rises, and the leads 15 pinched by the mount chuck 67 are inserted into the stem tube 18 supported by the holding chuck 56. One end of the stem tube 18 is thermally fused by a burner (not shown), thereby causing the leads 15 to be sealed in the stem tube 18. At point T3, a bimetal piece 16 is welded to one of the leads. Thus, a mount 12 is fabricated during both holding chuck 56 and mount chuck 67 are moved from point T1 to point T3. At point T4 the mount chuck 67 is opened, and the leads 15 clamped between the fixed lever 68 and movable lever 69 are freed, and the lifting table 62 falls. As a result, the mount 12 is moved forward by the chain 25, while the stem tube 18 is clamped by the holding chuck 56.

The holding chuck 56, while clamping the mount 12, leaves from the mount-fabricating unit 20 at point T4 and is carried straight forward. During this period, a adjustment of the warpage of the bimetal piece 16 and an azoic painting of the leads are performed in the electric furnace 28.

After passing the tension sprockets 51 and 52, the chain 25 and holding chuck 56 enter the sealing unit 21 at point T5. At point T5 the lifting table 71 and sealing chuck 79 of the sealing head 41 are let to fall. The upper end portion of the leads 15 of the mount 12 clamped by the holding chuck 56 is clamped by the sealing chuck 79. Later the holding chuck 56 is opened to release the clamping of the mount 12. Then the sealing head 41 rises to left the mount upward. As a result, the mount 12 caught by the holding chuck 56 is shifted to the sealing head 41, thereby rendering the holding chuck empty.

While kept in the above condition, the sealing head 41 and holding chuck 56 travel to point T6 at the same speed. At point T6, a bulb 10 is delivered to the empty holding chuck 56. After formed by the bulb-making unit 29, the bulb 10 is conducted to the holding chuck 56 by means of the chain conveyor 30.

The holding chuck 56 now holding the bulb 10 and the sealing head 79 supporting the mount 12 are moved at the same speed from point T6 to point T7 while facing each other. In the meantime, the sealing head 41 is moved downward, and the mount 12 is taken into the bulb 10 clamped the holding chuck 56. The upper open edge of the bulb 10 is fused and fixed to the mount 12. The stem tube of the mount 12 of the glow switch starter has a different diameter from the surrounding bulb 10. When the holding chuck 56 having the fixed chuck lever 58 and movable chuck lever 59 holds the stem tube and bulb having different diameters, then there is produced an off/center region S having a width of 2.0 to 2.5 mm as shown in FIG. 5 between the stem tube and bulb. Consequently, the stem tube of the mount 12 is supported by the sealing head 41 while being off centered from the bulb 10 clamped by the holding chuck 56. When, therefore, sealed in the bulb 10 under such condition, the mount 12 is undesirably rendered eccentric with respect to the bulb 10.

With the embodiment of this invention, therefore, the centering unit 31 (FIG. 3) for rendering the mount 12 concentric with the bulb 10 is provided between points T6, T7. Namely, when the sealing chuck 79 of the sealing head 41 is positioned right above the correction chuck 90 of the centering unit 31 while the sealing chuck 79 clamping the mount 12 and the holding chuck 56 clamping the bulb 10 are moved from point T6 to point T7 (FIG. 3), then the lifting block 86, slide table 89 and correction chuck 90 are interlockingly raised with the drive rod 87 (FIG. 9). As a result, the movable chuck levers 92 of the correction chuck 90 (FIG. 11) is set on both sides of the stem tube of the mount 12 clamped by the sealing chuck 79.

When, under this condition, the push rod 104 is moved toward the left side of FIG. 11, the plate 100 is shifted to the right. Since, at this time, the rollers 94 of the correction chuck 90 is released from the pressure of the plate 100, the movable chuck levers 92 of the correction chuck is closed by the spring 93 to clamp the stem tube of the mount 12. At this time, the rollers 101 of the sealing burners 98 is released from the pressure of the plate 100, causing the sealing burners to be drawn near the upper opening of the bulb 10 clamped by the holding chuck 56. When the stem tube of the mount 12 is clamped by the correction chuck 90, the sealing chuck 79 is opened to release the leads 15 of the mount 12, causing the mount 12 to be shifted from the sealing chuck 79 to the correction chuck 90.

Later, the lifting block 86, slide table 89 and correction chuck 90 are lowered together with the drive rod 87. While the slide table 89 is lowered, the cam roller 95 mounted thereon rolls over the cam surface **96*a* of the guide arm 96. As a result, the slidable table 89, together with the correction chuck 90, travels to the left of FIG. 12 along the guide rail 88. While, therefore, the correction chuck 90 is moved downward, the mount 12 is shifted crosswise in accordance with the shape of the cam surface 96*a*. This shifting corrects the offcenter region S between the stem tube of the mount 12 and the bulb 10. When, therefore, the correction chuck 90 moves to the lowermost position, the stem tube is concentrically inserted into the bulb 10 held by the holding chuck 56**.

At this time the sealing chuck 79 falls together with the correction chuck 90 to clamp again the leads 15 of the mount 12 whose centering action has been brought to an end. The upper open edge of the bulb 10 is fused by the sealing burner 98 to effect adhesion between the stem tube and bulb 10. After fusion is brought to an end, the correction chuck 90, sealing burners 98 and sealing chuck 79 are opened, and the sealing head 41 is lifted.

The holding chuck 56 clamping a product consisting of the mount 12 and bulb 10 leaves from the sealing unit 21 at point T7, and enters the evacuating unit 22 at point T8. As shown in FIG. 13, the evacuating head 45 is lifted by the lifting rod 109 at point T8. As a result, the bulb coupler 114 is connected in an airtight fashion to the lower end of the bulb 10 supported by the holding chuck 56. Under this condition, the holding chuck 56 and evacuating head 45 travel at the same speed from point T8 to point T9. In the meantime, the bulb 10 is evacuated through the bulb coupler 114, rubber hose 116 and pipe 117 (FIG. 13), and at the same time an inert gas is taken into the bulb. Later, the smaller diameter section of the bulb 10 is hermetically sealed by a burner (not shown), and severed from the adjacent section.

When the evacuation of the bulb 10 and the introduction of an inert gas thereinto are finished, the evacuation head 45 is lowered at point T9, and the bulb coupler 114 is taken off the bulb 10. While being clamped by the holding chuck 56, a finished glow switch starter leaves the evacuating unit 22 at point T9 and is carried to point T10. In the meantime, by the lead-processing unit 32, one of the leads is bent outward and an insulating material is taken into the stem tube to effect insulation between the paired leads. At point 10, the glow switch starter is shifted to the chain conveyor 33 and carried to a prescribed site thereby. The above-mentioned sequential steps are taken in succession for the mounts or bulbs supported by the plural holding chucks 56 fitted to the chain 25, thereby effecting the continuous manufacture of numerous glow switch starters.

With the manufacturing apparatus arranged as described above, the mount and bulb are transported to the mount-making unit, sealing unit and evacuating unit while being clamped by the holding chuck to undergo the required treatments by the units. Therefore, the delivery and pickup of parts between the travelling chain and the respective treating units are carried out with an extremely low frequency. In the foregoing embodiment, the delivery and pickup of parts take place only at point T6 shown in FIG. 3. Thus, this manufacturing apparatus offers the advantages that it is unnecessary to provide numerous shifting mechanisms as has been the case with the conventional manufacturing apparatus. Therefore, required parts are reduced in number, constructions are simplified, and maintenance is facilitated. Further, mounts and bulbs are less likely to be damaged by errors which might take place in the delivery and pick up processes, since the mounts and bulbs are delivered and picked up with for smaller frequency than in the conventional apparatus, thereby improving in the yield. The glow switch starter can be manufactured at higher speed to improve manufacture efficiency.

The chain is engaged with the first to third sprockets interlockingly driven with the turn tables 35, 39, 43 of the respective processing units and driven thereby. Therefore, the holding chucks mounted on the chain travel, in alignment with the heads supported on the respective turn tables, thereby enabling the holding chucks and the processing heads to be operated together with an extremely high precision. Thus, errors in the delivery and pickup of parts are reduced with an improvement in the yield.

In the foregoing embodiment, the holding chuck comprises one fixed chuck lever and one movable chuck lever. Therefore, a mechanism for opening and closing the chuck can be more simplified than in the case where both chuck levers are made movable. There is no possibility of parts in transit being insecurely supported due to the swaying of the chucks. Though the holding chucks of the above-mentioned type are used, a centering device is provided to ensure the accurate centering of the mount with the bulb, thereby enabling the products to be manufactured with sufficiently high precision.

This invention is not limited to the aforementioned embodiment, but is applicable with various modifications without departing from the scope and object of the invention.

The foregoing embodiment refers to the case where the apparatus is applied to the manufacture of glow switch starters. Obviously, the invention can be used for the fabrication of any other lamp. For example, a small baseless electric lamp can be fabricated through the same steps as described above except that a filament is stretched between a pair of leads in place of a bimetal wire. Thus, by supplying filament in stead of bimetals the apparatus of this invention can be applied to the manufacture of small baseless lamps. Further, the foregoing embodiment referred to the case the mount consisted of a stem tube. However, the mount may be composed of a tandem stem or bead stem. In the foregoing embodiment, a chain is used as the conveyor, but a toothed belt may be used. However, if cost and wear are taken into account, the conveyor should preferably be formed of a chain. In the case of a chain conveyor, a chain pin can be applied in fitting a holding chuck to the conveyor, dispensing with any other extra part. In the aforementioned embodiment, the first to third sprockets are driven at the same time by a single motor. If, however, at least one sprocket is driven by a motor, the chain and another sprocket can be simultaneously driven. Obviously it is possible to drive the sprockets independently by the corresponding drive sources.

What is claimed is:

1. An apparatus for manufacturing electric lamps having a bulb and a mount which includes a pair of leads and a stem tube, said apparatus comprising:

an endless conveyor traveling along a prescribed path;

holding means for selectively holding the mount or bulb, said holding means being supported by the conveyor and integrally traveling therewith;

drive means for driving the endless conveyor;

stem tube-feeding means for feeding a stem tube to the holding means;

a mount-making unit arranged near the path of the conveyor, for sealing a pair of leads in the stem tube fed to the holding means from the stem tube-feeding means and held by the holding means, thereby fabricating a mount;

bulb-feeding means for delivering a bulb to the holding means;

a sealing unit arranged near the path of the conveyor, for taking up the mount from the holding means which has passed the mount-making unit and sealing the mount into the bulb fed to the holding means from the bulb-feeding means and held by the holding means; and an evacuating unit arranged near the path of the conveyor, for evacuating the bulb held by the holding means which has passed the sealing unit, introducing an inert gas into the bulb, and sealing the bulb.

2. The apparatus according to claim 1, wherein said drive means includes first, second and third rotatable drive members fitted to the mount-making unit, sealing unit and evacuating unit, respectively, and a drive source for rotating at least one of the first to third drive members; and wherein said conveyor is stretched over the first to third drive members and driven in accordance with the rotation of the drive members.

3. The apparatus according to claim 2, wherein said holding means includes a plurality of holding chucks for clamping the stem tube or bulb which are arranged at a prescribed distance in the traveling direction of the conveyor.

4. The apparatus according to claim 3, wherein said mount-making unit includes a plurality of mount heads arranged in a circle around the rotation axis of the first drive member at the same pitch as the holding chucks, and rotated integrally with the first drive member, each of the mount heads being provided with a mount chuck for clamping a pair of leads and inserting the leads into the stem tube clamped by the holding chuck; said sealing unit includes a plurality of sealing heads arranged in a circle around the rotation axis of the second drive member at the same pitch as the holding chucks, and rotated integrally with the second drive member about its rotation axis, each of the sealing heads being provided with a sealing chuck movable along the rotation axis of the second drive member, for clamping the leads of the mount; and said evacuating unit includes a plurality of evacuation heads arranged in a circle around the rotation axis of the third drive member at the same pitch as the holding chucks, and rotated with the third drive member about its rotation axis, each of the evacuation heads evacuating the bulb clamped by the holding chuck and introducing an inert gas into the bulb.

5. The apparatus according to claim 2, wherein said first to third drive members are provided with sprockets rotatable on the same plane, and said conveyor has a chain engaged with the sprockets.

6. The apparatus according to claim 5, wherein said drive means includes a motor and transmission means for transmitting the rotational force of the motor to the first to third drive members to rotate the members at the same angular speed.

7. The apparatus according to claim 5, wherein said holding means includes a plurality of chucks for selectively clamping a stem tube or bulb need, each of said chucks having a coupler fixed to the chain by the chain pin of the chain, a fixed chuck lever fitted to the coupler, and a movable chuck lever fitted to the coupler to selectively clamp the stem tube or bulb in cooperation with the fixed chuck lever.

8. The apparatus according to claim 5, which further comprises tension sprockets engaged with the chain to impart a prescribed tension to the chain, and a plurality of intermediate sprockets engaged with the chain to take up the chain about the first, second or third sprocket.

9. The apparatus according to claim 1, wherein said holding means includes a chuck for clamping the stem tube or bulb, and which further comprises a centering unit arranged near the path of the conveyor, for centering the mount with the bulb when the mount is inserted into the bulb in the sealing unit.

10. The apparatus according to claim 9, wherein said centering unit includes a vertically movable correction chuck for holding the stem tube, and a cam member engaged with the correction chuck to horizontally shift the correction chuck for a prescribed distance in accordance with the extent of the vertical movement of the correction chuck.

* * * * *